US012496680B2

(12) United States Patent
Tateno et al.

(10) Patent No.: US 12,496,680 B2
(45) Date of Patent: Dec. 16, 2025

(54) POLISHING PAD AND METHOD FOR MANUFACTURING POLISHED PRODUCT

(71) Applicant: FUJIBO HOLDINGS, INC., Tokyo (JP)

(72) Inventors: Teppei Tateno, Ehime (JP); Ryuma Matsuoka, Ehime (JP); Hiroshi Kurihara, Ehime (JP); Satsuki Narushima, Ehime (JP); Yamato Takamizawa, Ehime (JP)

(73) Assignee: FUJIBO HOLDINGS, INC., Tokyo (JP)

( * ) Notice: Subject to any disclaimer, the term of this patent is extended or adjusted under 35 U.S.C. 154(b) by 369 days.

(21) Appl. No.: 18/029,073

(22) PCT Filed: Sep. 27, 2021

(86) PCT No.: PCT/JP2021/035318
§ 371 (c)(1),
(2) Date: Mar. 28, 2023

(87) PCT Pub. No.: WO2022/071205
PCT Pub. Date: Apr. 7, 2022

(65) Prior Publication Data

US 2023/0373055 A1 Nov. 23, 2023

(30) Foreign Application Priority Data

Sep. 30, 2020 (JP) ..... 2020-166169

(51) Int. Cl.
*B24B 37/22* (2012.01)
*B24B 37/24* (2012.01)

(52) U.S. Cl.
CPC ..... *B24B 37/22* (2013.01); *B24B 37/24* (2013.01)

(58) Field of Classification Search
CPC ..... B24B 37/20; B24B 37/22; B24B 37/24; B24B 37/26; B24D 3/20; B24D 3/22;
(Continued)

(56) References Cited

U.S. PATENT DOCUMENTS

2019/0168356 A1* 6/2019 Qian ..... B24B 37/044

FOREIGN PATENT DOCUMENTS

CN 101238178 A * 8/2008 ..... B24D 3/28
EP 1522385 A2 4/2005
(Continued)

OTHER PUBLICATIONS

International Search Report mailed Nov. 16, 2021, for International Application No. PCT/JP2021/035318, with English translation, 5 pages.

*Primary Examiner* — Joel D Crandall
(74) *Attorney, Agent, or Firm* — Squire Patton Boggs (US) LLP

(57) ABSTRACT

The present invention relates to a polishing pad including a polishing layer and a cushion layer, wherein a ratio $E'_{B40}/E'_{C40}$ of a storage elastic modulus at 40° C. in dynamic viscoelasticity measurement performed under a bending mode condition with a dry state, a frequency of 10 rad/s, and 20 to 100° C., $E'_{B40}$, to a storage elastic modulus at 40° C. in dynamic viscoelasticity measurement performed under a compression mode condition with a dry state, a frequency of 10 rad/s, and 20 to 100° C., $E'_{C40}$, is 3.0 or more and 15.0 or less, and a loss factor tan δ in the dynamic viscoelasticity measurement performed under the bending mode condition is 0.10 or more and 0.30 or less in a range of 40° C. or more and 70° C. or less.

8 Claims, 4 Drawing Sheets

(58) Field of Classification Search
CPC ... B24D 3/24; B24D 3/26; B24D 3/28; B24D 3/285; B24D 3/30; B24D 3/32; B24D 3/34; B24D 3/342; B24D 3/344
See application file for complete search history.

(56) References Cited

FOREIGN PATENT DOCUMENTS

| | | | | | |
|---|---|---|---|---|---|
| JP | 2004-507076 | A | | 3/2004 | |
| JP | 2005-136400 | A | | 5/2005 | |
| WO | WO 2001/091971 | A1 | | 12/2001 | |
| WO | WO-0246283 | A1 | * | 6/2002 | ..... B24B 37/24 |
| WO | WO-2019188577 | A1 | * | 10/2019 | ..... B24B 37/24 |

* cited by examiner

[Figure 1]
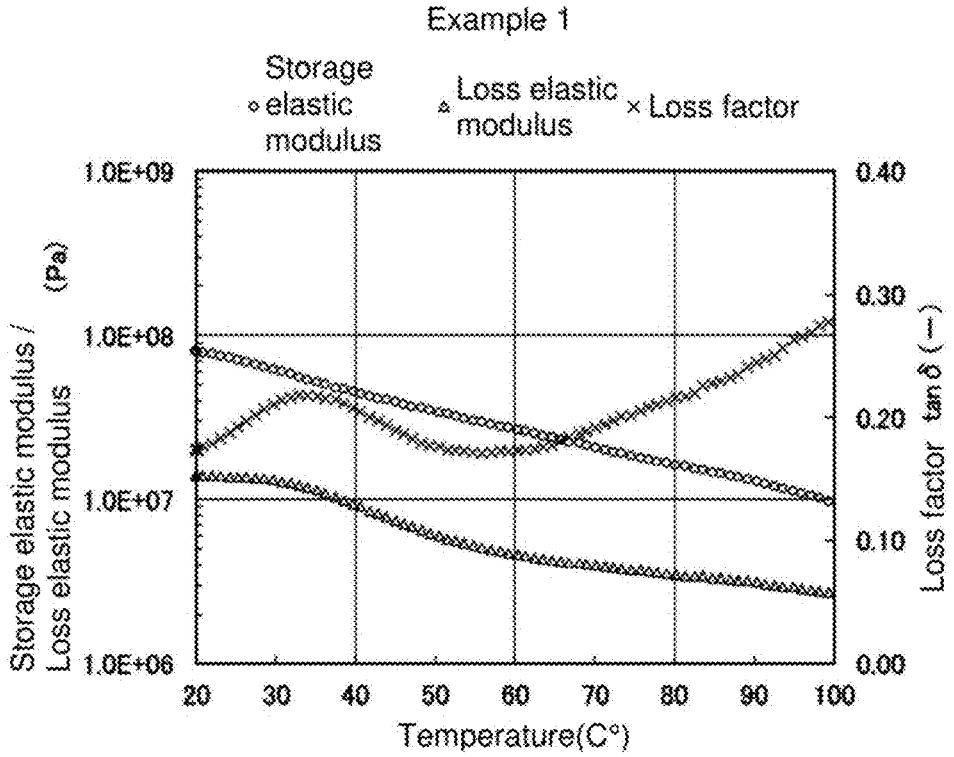

[Figure 2]
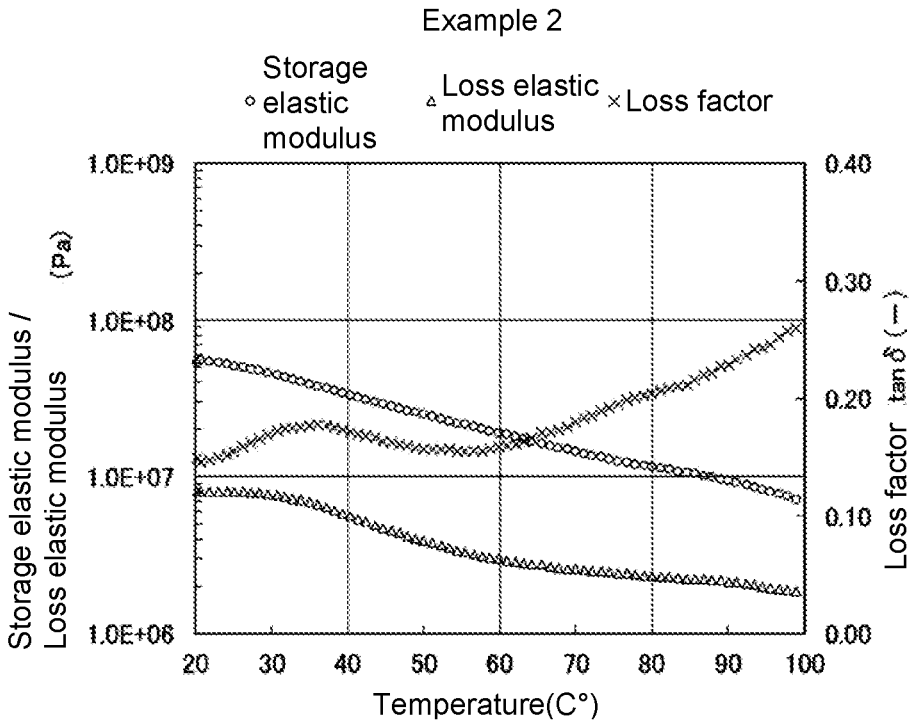
[Figure 3]
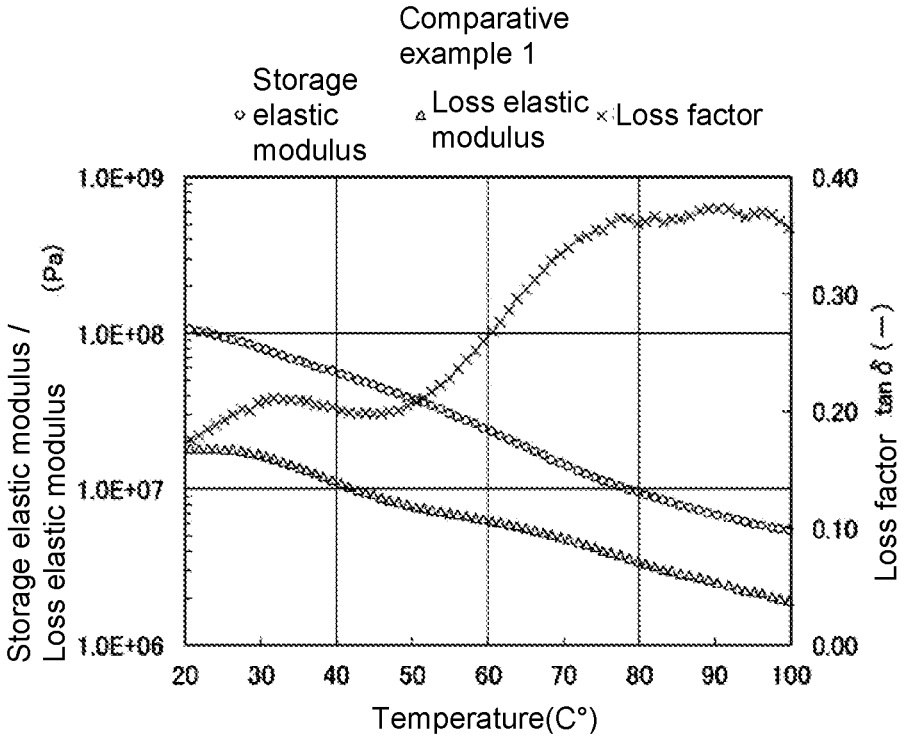

[Figure 4]
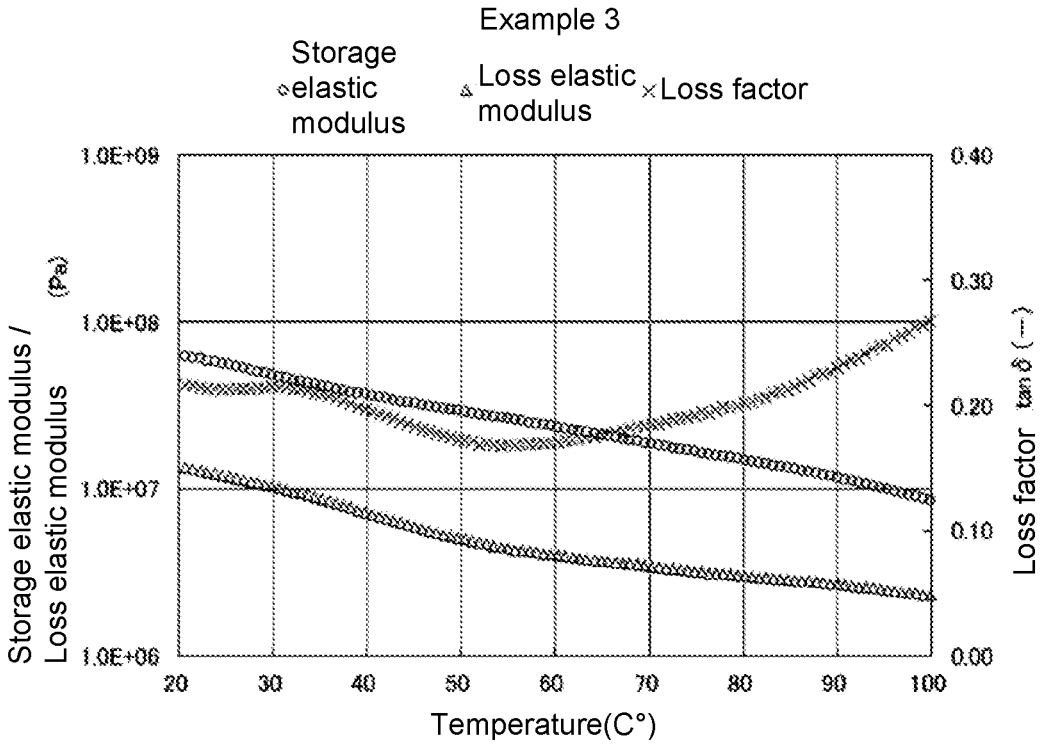

[Figure 5]
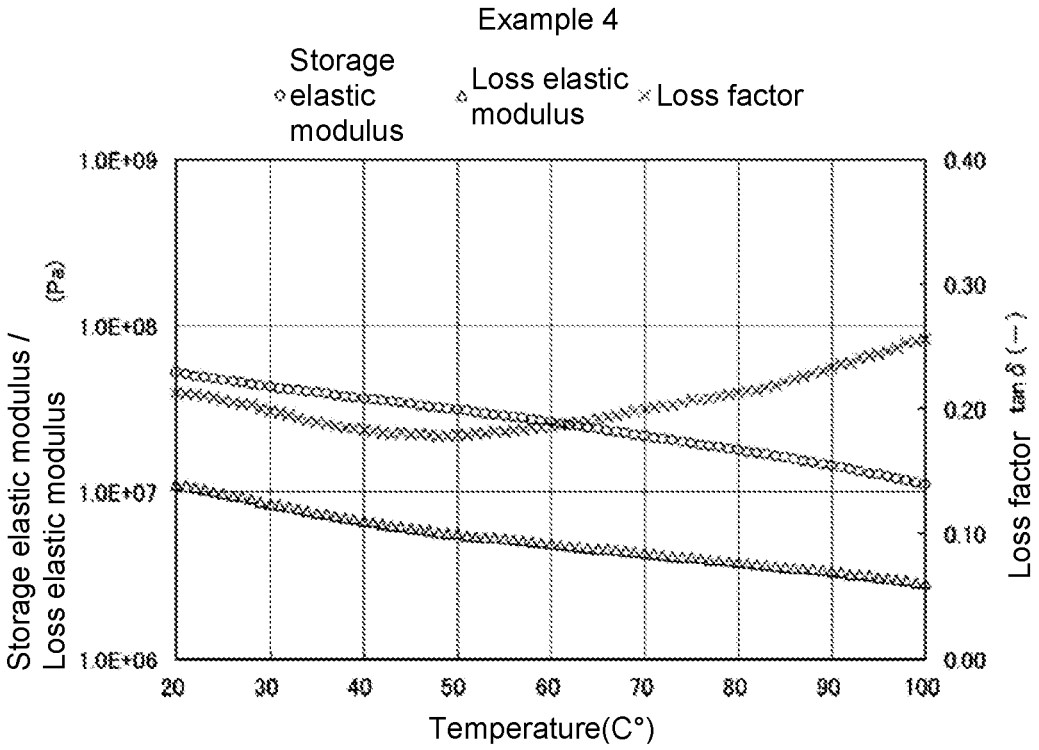

POLISHING PAD AND METHOD FOR MANUFACTURING POLISHED PRODUCT

CROSS-REFERENCE

This application is a National Stage filing under 35 U.S.C. § 371 of International Patent Application No. PCT/JP2021/035318, filed Sep. 27, 2021, which claims the benefit of and priority to JP Application No. 2020-166169, filed Sep. 30, 2020, all of these applications which are incorporated herein by reference in their entirety for all purposes.

TECHNICAL FIELD

The present invention relates to a polishing pad and a method for manufacturing a polished product.

BACKGROUND ART

Polishing processing using a polishing pad is performed on materials such as optical materials such as lenses, plane parallel plates, and reflective mirrors, semiconductor wafers, semiconductor devices, and hard disk substrates. In the polishing processing of semiconductor devices in which an oxide layer, a metal layer, and/or the like are formed on a semiconductor wafer, among them, particularly flatness is required.

So far, various polishing pads have been developed for the purpose of improving the flatness of the polished surface of an object to be polished, and the like. For example, Patent Literature 1 discloses a polishing pad for flattening the surface of a semiconductor device or its precursor, in which the ratio between the values of the storage elastic moduli E' of the polishing layer at 30° C. and at 90° C. is in the range of about 1 to 3.6. According to Patent Literature 1, it is disclosed that such a polishing pad has low elastic recovery, and exhibits significant inelasticity in contrast to many known polishing pads.

Patent Literature 2 discloses a polishing pad including a polymer material having at least a porosity of 0.1% by volume, an energy loss factor KEL of 385 to 750 (1/Pa) at 40° C. and 1 rad/sec, and an elastic modulus E' of 100 to 400 (MPa) at 40° C. and 1 rad/sec. According to Patent Literature 2, it is disclosed that such a polishing pad is useful for flattening semiconductor base materials.

CITATION LIST

Patent Literature

Patent Literature 1: Japanese Translation of PCT International Application Publication No. 2004-507076

Patent Literature 2: Japanese Patent Laid-Open No. 2005-136400

SUMMARY OF INVENTION

Technical Problem

The evaluation items of flatness include one due to a phenomenon in which a wiring cross section is depressed in a dish shape mainly in a wide wiring pattern, referred to as dishing, and one due to a phenomenon in which an insulating film is eroded together with copper and the like mainly in a fine wiring portion, referred to as erosion.

The Patent Literatures 1 and 2 recite the configuration of the polishing layer for the purpose of the improvement of dishing and erosion (hereinafter also collectively referred to as "flatness"). However, it has been found by the study of the present inventors that in a polishing pad including a cushion layer and a polishing layer, even if only the configuration of the polishing layer is specified, sufficient flatness may not be obtained on the polished surface of an object to be polished, depending on the combination with the cushion layer.

The present invention has been made in view of the problem, and it is an object of the present invention to provide a polishing pad that can provide good flatness to an object to be polished, and a method for manufacturing a polished product using the same.

Solution to Problem

The present inventors have studied diligently in order to solve the problem, and as a result, have found that the problem can be solved by a polishing pad including a polishing layer and a cushion layer, wherein the ratio between the storage elastic modulus in dynamic viscoelasticity measurement in compression mode and the storage elastic modulus in dynamic viscoelasticity measurement in bending mode is in a predetermined range, and the loss factor tan δ in the dynamic viscoelasticity measurement in the bending mode satisfies a predetermined condition, and a method for manufacturing a polished product using the polishing pad, leading to completion of the present invention.

That is, the present invention is as follows.

[1]

A polishing pad including a polishing layer and a cushion layer, wherein a ratio of a storage elastic modulus at 40° C. in dynamic viscoelasticity measurement performed under a bending mode condition with a dry state, a frequency of 10 rad/s, and 20 to 100° C., $E'_{B40}$, to a storage elastic modulus at 40° C. in dynamic viscoelasticity measurement performed under a compression mode condition with a dry state, a frequency of 10 rad/s, and 20 to 100° C., $E'_{C40}$, the ratio being $E'_{B40}/E'_{C40}$, is 3.0 or more and 15.0 or less, and a loss factor tan δ in the dynamic viscoelasticity measurement performed under the bending mode condition is 0.10 or more and 0.30 or less in a range of 40° C. or more and 70° C. or less.

[2]

The polishing pad according to [1], wherein a ratio of a storage elastic modulus at 30° C., $E'_{B30}$, to a storage elastic modulus at 90° C., $E'_{B90}$, the ratio being $E'_{B30}/E'_{B90}$, in the dynamic viscoelasticity measurement performed under the bending mode condition is 1.0 or more and 8.0 or less.

[3]

The polishing pad according to [1] or [2], wherein a density of the cushion layer is 0.10 g/cm$^3$ or more and 0.60 g/cm$^3$ or less, and a compressibility of the cushion layer is 3.0% or more and 30.0% or less.

[4]

The polishing pad according to any one of [1] to [3], wherein a density of the polishing layer is 0.60 g/cm$^3$ or more and 1.1 g/cm$^3$ or less, and a compressibility of the polishing layer is 0.10% or more and 3.0% or less.

[5]

The polishing pad according to any one of [1] to [4], wherein a Shore D hardness of the polishing layer is 40 or more and 80 or less.

[6]

The polishing pad according to any one of [1] to [5], wherein a ratio of a thickness of the cushion layer to a thickness of the polishing layer is 0.50 or more and 2.0 or less.

[7]

The polishing pad according to any one of [1] to [6], wherein the polishing layer contains a polyurethane resin.

[8]

A method for manufacturing a polished product, including:

a polishing step of polishing an object to be polished, using the polishing pad according to any one of [1] to [7].

Advantageous Effect of Invention

According to the present invention, it is possible to provide a polishing pad that can provide good flatness to an object to be polished, and a method for manufacturing a polished product using the same.

BRIEF DESCRIPTION OF DRAWINGS

FIG. 1 is a diagram showing the results of dynamic viscoelasticity measurements in a bending mode in Example 1.

FIG. 2 is a diagram showing the results of the dynamic viscoelasticity measurements in the bending mode in Example 2.

FIG. 3 is a diagram showing the results of the dynamic viscoelasticity measurements in the bending mode in Comparative Example 1.

FIG. 4 is a diagram showing the results of the dynamic viscoelasticity measurements in the bending mode in Example 3.

FIG. 5 is a diagram showing the results of the dynamic viscoelasticity measurements in the bending mode in Example 4.

DESCRIPTION OF EMBODIMENT

An embodiment of the present invention (hereinafter referred to as "this embodiment") will be described in detail below, but the present invention is not limited to this, and various modifications can be made without departing from the spirit thereof.

[Polishing Pad]

The polishing pad of this embodiment includes a polishing layer and a cushion layer, a ratio $E'_{B40}/E'_{C40}$ of a storage elastic modulus at 40° C. in dynamic viscoelasticity measurement performed under a bending mode condition with a dry state, a frequency of 10 rad/s, and 20 to 100° C., $E'_{B40}$, to a storage elastic modulus at 40° C. in dynamic viscoelasticity measurement performed under a compression mode condition of a dry state, a frequency of 10 rad/s, and 20 to 100° C., $E'_{C40}$, is 3.0 or more and 15.0 or less, and a loss factor tan δ in the dynamic viscoelasticity measurement performed under the bending mode condition is 0.10 or more and 0.30 or less in the range of 40° C. or more and 70° C. or less.

In conventional polishing pads, the physical properties have often been controlled for only the polishing layer, and the relationship between the dynamic viscoelasticity for the entire polishing pad, including the cushion layer and the polishing layer, and the flatness of an object to be polished has hardly been studied.

In contrast to this, the polishing pad of this embodiment can provide good flatness to an object to be polished by ensuring that the measurement results of dynamic viscoelasticity measurement in which measurement is performed for the entire polishing pad including the polishing layer and the cushion layer satisfy predetermined conditions.

(Dynamic Viscoelasticity Measurement)

As the measurement modes in dynamic viscoelasticity measurement, a tensile mode, a bending mode, a compression mode, and the like are known. The present inventors have studied diligently and, as a result, found that when a measurement result of a bending mode and a measurement result of a compression mode are in a predetermined relationship, and the measurement result of the bending mode satisfies a predetermined condition, the combination of the polishing layer and the cushion layer is preferred, and good flatness can be provided to an object to be polished.

That is, in the polishing pad of this embodiment, the ratio of the storage elastic modulus at 40° C. in dynamic viscoelasticity measurement performed under a bending mode condition with a dry state, a frequency of 10 rad/s, and 20 to 100° C. (this measurement is hereinafter simply referred to as "the dynamic viscoelasticity measurement in the bending mode"), $E'_{B40}$, to the storage elastic modulus at 40° C. in dynamic viscoelasticity measurement performed under a compression mode condition with a dry state, a frequency of 10 rad/s, and 20 to 100° C. (this measurement is hereinafter simply referred to as "the dynamic viscoelasticity measurement in the compression mode"), $E'_{C40}$, the ratio being $E'_{B40}/E'_{C40}$, is 3.0 or more and 15.0 or less, and the loss factor tan δ in the dynamic viscoelasticity measurement performed under the bending mode condition is 0.10 or more and 0.30 or less in the range of 40° C. or more and 70° C. or less.

In the polishing pad of this embodiment, the ratio $E'_{B40}/E'_{C40}$ of the storage elastic modulus at 40° C. in the dynamic viscoelasticity measurement in the bending mode, $E'_{B40}$, to the storage elastic modulus at 40° C. in the dynamic viscoelasticity measurement in the compression mode, $E'_{C40}$, is 3.0 or more and 15.0 or less, and therefore it is presumed that the polishing pad of this embodiment can respond to both of polishing pressure applied to a wide range of the polishing pad, and the force from the edge of an object to be polished (or the way it is contacted as such) in good balance, and can provide good flatness to the object to be polished. A portion in which the edge of an object to be polished is repeatedly pressed is present in the polishing pad during polishing. The polishing pad "responding to the force from the edge of an object to be polished" means that without excessive polishing pressure being applied, or the polishing pad sagging, even for such a local strain close to the bending direction, the way the polishing pad contacts the edge of an object to be polished is good, and uniform polishing can be performed.

Further, in the polishing pad of this embodiment, the loss factor tan δ in the dynamic viscoelasticity measurement in the bending mode is 0.10 or more and 0.30 or less in the range of 40° C. or more and 70° C. or less, that is, the fluctuations in the loss factor tan δ are small in a wide range of the temperature region. The loss tangent, tan δ, is a value represented by the ratio of the loss elastic modulus E" (viscous component) to the storage elastic modulus E' (elastic component) and is an indicator showing the balance between the elasticity and viscosity that a material to be measured exhibits under a measurement condition. Therefore, it is presumed that in the polishing pad of this embodiment in which the fluctuations in the loss factor tan δ in the dynamic viscoelasticity measurement in the bending mode are small in a wide range of the temperature region, changes in the physical properties of the polishing pad due to heat generated during polishing processing are suppressed, and good flatness can be provided to an object to be polished. However, the factor of the fact that the polishing pad of this embodiment can provide good flatness to an object to be polished is not limited to the above.

In the polishing pad, the ratio $E'_{B40}/E'_{C40}$ is 3.0 or more and 15.0 or less. From the viewpoint of even more improving the balance between responsivity to polishing pressure applied to a wide range of the polishing pad and responsivity to the force with which the polishing pad contacts the edge of an object to be polished, the ratio $E'_{B40}/E'_{C40}$ is preferably 4.0 or more and 12.5 or less, more preferably 4.5 or more and 8.0 or less, and further preferably 5.0 or more and 7.0 or less.

Here, the storage elastic modulus at 40° C. in the dynamic viscoelasticity measurement in the compression mode, $E'_{C40}$, tends to be more affected by the physical properties of the cushion layer than the physical properties of the polishing layer, whereas the storage elastic modulus at 40° C. in the dynamic viscoelasticity measurement in the bending mode, $E'_{B40}$, tends to be more affected by the physical properties of the polishing layer than the physical properties of the cushion layer. Therefore, when a cushion layer having a low storage elastic modulus is used, the ratio $E'_{B40}/E'_{C40}$ tends to increase, and when a polishing layer having a high storage elastic modulus is used, the ratio $E'_{B40}/E'_{C40}$ tends to increase.

From the viewpoint of increasing responsivity to polishing pressure applied to a wide range of the polishing pad, the storage elastic modulus at 40° C. in the dynamic viscoelasticity measurement in the compression mode, $E'_{C40}$, is preferably 2.0 MPa or more and 12.0 MPa or less, more preferably 3.0 MPa or more and 10.0 MPa or less, and further preferably 4.0 MPa or more and 9.0 MPa or less.

From the viewpoint of increasing responsivity to the force with which the polishing pad contacts the edge of an object to be polished, the storage elastic modulus at 40° C. in the dynamic viscoelasticity measurement in the bending mode, $E'_{B40}$, is preferably 25.0 MPa or more and 55.0 MPa or less, more preferably 27.0 MPa or more and 53.0 MPa or less, further preferably 30.0 MPa or more and 50.0 MPa or less, and still more preferably 35.0 MPa or more and 50.0 MPa or less.

In the polishing pad, the loss factor tan δ in the dynamic viscoelasticity measurement in the bending mode is 0.10 or more and 0.30 or less in the range of 40° C. or more and 70° C. or less. In other words, in the polishing pad, the maximum value of the loss factor tan δ in the range of 40° C. or more and 70° C. or less is 0.30 or less, and the minimum value of the loss factor tan δ in the range of 40° C. or more and 70° C. or less is 0.10 or more.

From the viewpoint of even more suppressing changes in the physical properties of the polishing pad during polishing processing, the loss factor tan δ in the dynamic viscoelasticity measurement in the bending mode is preferably in the range of 0.13 or more and 0.28 or less, more preferably in the range of 0.15 or more and 0.25 or less, in the range of 40° C. or more and 70° C. or less. From the same viewpoint, the loss factor tan δ in the dynamic viscoelasticity measurement in the bending mode is preferably 0.10 or more and 0.30 or less in the range of 30° C. or more and 80° C. or less, more preferably 0.10 or more and 0.30 or less in the range of 25° C. or more and 90° C. or less. By using a polishing layer in which the fluctuations in the loss factor tan δ in the dynamic viscoelasticity measurement in the bending mode are small in the temperature range, the loss factor tan δ for the polishing pad tends to be able to be controlled within the range.

From the viewpoint of even more suppressing changes in the physical properties of the polishing pad during polishing processing, the ratio of the storage elastic modulus at 30° C., $E'_{B30}$, to the storage elastic modulus at 90° C., $E'_{B90}$, the ratio being $E'_{B30}/E'_{B90}$, in the dynamic viscoelasticity measurement in the bending mode is preferably 1.0 or more and 8.0 or less, more preferably 2.0 or more and 7.0 or less, and further preferably 3.0 or more and 6.0 or less. By using a polishing layer in which the fluctuations in the storage elastic modulus E' in the dynamic viscoelasticity measurement in the bending mode are small in the range of 30° C. to 90° C., the ratio $E'_{B30}/E'_{B90}$ in the polishing pad tends to be able to be controlled within the range.

The dynamic viscoelasticity measurement of this embodiment can be performed according to an ordinary method. In dynamic viscoelasticity measurement in a dry state, the polishing pad held in a constant temperature and humidity tank at a temperature of 23° C. and a relative humidity of 50% for 40 h is used as a measurement sample, and the measurement of the sample is performed under the usual air atmosphere (dry state). Examples of dynamic viscoelasticity measuring apparatuses capable of such a measurement include the product name "RSA3" manufactured by TA Instruments. Other conditions are not particularly limited, and, for example, the measurement can be performed by a method described in Examples.

(Polishing Layer)

The polishing layer that the polishing pad includes is not particularly limited as long as the measurement results of the dynamic viscoelasticity measurement for the polishing pad satisfy the above conditions. Examples of the polishing layer include one containing a polyurethane resin.

The polyurethane resin is not particularly limited, and examples thereof include polyester-based polyurethane resins, polyether-based polyurethane resins, and polycarbonate-based polyurethane resins. The polishing layer may contain one of these polyurethane resins alone or two or more of these polyurethane resins.

Among them, polyester-based polyurethane resins and polyether-based polyurethane resins are preferred. Particularly, polyurethane resins that are cured products of compositions including urethane prepolymers and curing agents are preferred. Such polyurethane resins are not particularly limited as long as they are cured products of urethane prepolymers and curing agents. Conventionally known ones can be used.

The polishing layer preferably has cells. When the polishing layer has cells, the forms of the cells include closed cells in which a plurality of cells are independently present, and open cells in which a plurality of cells are connected by a communicating hole. Of these, the polishing layer preferably has closed cells. "Mainly have closed cells" means that the closed cell ratio measured according to ASTM standards (ASTM D2856) is 60% or more.

The density of the polishing layer is preferably 0.60 g/cm$^3$ or more and 1.1 g/cm$^3$ or less, more preferably 0.65 g/cm$^3$ or more and 1.0 g/cm$^3$ or less, and further preferably 0.70 g/cm$^3$ or more and 0.90 g/cm$^3$ or less. When the density of the polishing layer is within the range, the storage elastic modulus $E'_{B40}$ tends to be even more easily within the preferred range. The density of the polishing layer can be controlled by adjusting the proportion of the cells in the polishing layer.

The compressibility of the polishing layer is preferably 0.10% or more and 3.0% or less, more preferably 0.30 or more and 2.0% or less, and further preferably 0.50% or more and 1.5% or less. When the compressibility of the polishing layer is within the range, the storage elastic modulus $E'_{B40}$ tends to be even more easily within the preferred range. The compressibility of the polishing layer can be controlled by adjusting the proportion of the cells in the polishing layer.

The measurement of the compressibility can be carried out according to Japanese Industrial Standards (JIS L 1021) using a Schopper type thickness gauge. Specifically, the compressibility can be calculated from the following formula by measuring the thickness t0 after applying an initial load from the no-load state for 30 s, and next measuring the thickness t1 after applying final pressure from the thickness t0 state for 5 min.

$$\text{compressibility } (\%)=100\times(t0-t1)/t0$$

The compressive elastic modulus of the polishing layer is preferably 60% or more and 95% or less, more preferably 65% or more and 90% or less, and further preferably 70% or more and 85% or less. When the compressive elastic modulus of the polishing layer is within the range, even better flatness tends to be able to be provided to an object to be polished. The compressive elastic modulus of the polishing layer can be controlled by appropriately adjusting and selecting the proportion of the cells in the polishing layer, the material of the polishing layer, and the like.

The measurement of the compressive elastic modulus can be carried out according to Japanese Industrial Standards (JIS L 1021) using a Schopper type thickness gauge. Specifically, the compressive elastic modulus can be calculated from the following formula by measuring the thickness t0 after applying an initial load from the no-load state for 30 s, next measuring the thickness t1 after applying final pressure from the thickness t0 state for 5 min, and further measuring the thickness t0' after removing all loads from the thickness t1 state, followed by standing (no-load state) for 5 min, and then applying an initial load for 30 s again.

$$\text{compressive elastic modulus } (\%)=100\times(t0'-t1)/(t0-t1)$$

A Shore D hardness of the polishing layer is preferably 40 or more and 80 or less, more preferably 45 or more and 75 or less, and further preferably 50 or more and 70 or less. When the Shore D hardness of the polishing layer is within the range, even better flatness tends to be able to be provided to an object to be polished, and the occurrence of scratches tends to be able to be even more suppressed. The hardness of the polishing layer can be controlled by appropriately adjusting and selecting the proportion of the cells in the polishing layer, the material of the polishing layer, and the like. The Shore D hardness of the polishing layer can be carried out according to Japanese Industrial Standards (JIS K 7311) using a D type hardness meter.

The thickness of the polishing layer is not particularly limited and may be 0.50 mm or more and 3.0 mm or less, 0.70 mm or more and 2.5 mm or less, or 0.90 mm or more and 2.0 mm or less. The thickness of the polishing layer is preferably adjusted by the ratio of the thickness of the cushion layer as described later.

(Cushion Layer)

The cushion layer that the polishing pad includes is not particularly limited as long as the measurement results of the dynamic viscoelasticity measurement for the polishing pad satisfy the above conditions. Examples of the cushion layer include one having high cushioning properties compared with the polishing layer.

The density of the cushion layer is preferably lower than the density of the polishing layer, more preferably 0.20 g/cm$^3$ or more lower than the density of the polishing layer, and further preferably 0.22 g/cm$^3$ or more lower than the density of the polishing layer. The density of the cushion layer may be 0.30 g/cm$^3$ or more lower than the density of the polishing layer. The density of the cushion layer is preferably 0.080 g/cm$^3$ or more and 0.65 g/cm$^3$ or less, more preferably 0.10 g/cm$^3$ or more and 0.60 g/cm$^3$ or less. The density of the cushion layer may be 0.15 g/cm$^3$ or more and 0.50 g/cm$^3$ or less, or 0.20 g/cm$^3$ or more and 0.40 g/cm$^3$ or less. When the density of the cushion layer is within the range, the cushioning properties of the cushion layer tend to improve even more, and even better flatness tends to be able to be provided to an object to be polished.

The compressibility of the cushion layer is preferably higher than the compressibility of the polishing layer, more preferably 2.5% points (percentage points) or more higher than the compressibility of the polishing layer, and further preferably 3.0% points or more higher than the compressibility of the polishing layer. The compressibility of the cushion layer may be 5.0% points or more higher than the compressibility of the polishing layer. The compressibility of the cushion layer is preferably 3.0% or more and 30.0% or less, more preferably 3.5% or more and 27.5% or less. The compressibility of the cushion layer may be 4.0% or more and 25.0% or less, or 5.0% or more and 20.0% or less. When the compressibility of the cushion layer is within the range, the cushioning properties of the cushion layer tend to improve even more, and even better flatness tends to be able to be provided to an object to be polished.

The compressive elastic modulus of the cushion layer is preferably higher than the compressive elastic modulus of the polishing layer, more preferably 5.0% points or more higher than the compressive elastic modulus of the polishing layer, and further preferably 7.0% points or more higher than the compressive elastic modulus of the polishing layer. The compressive elastic modulus of the cushion layer is preferably 75% or more and 100% or less, more preferably 80% or more and 99% or less, and further preferably 85% or more and 99% or less. When the compressive elastic modulus of the cushion layer is within the range, the cushioning properties of the cushion layer tend to improve even more, and even better flatness tends to be able to be provided to an object to be polished.

A Shore A hardness of the cushion layer is preferably 15 or more and 70 or less, more preferably 17 or more and 65 or less, further preferably 20 or more and 60 or less, and still more preferably 30 or more and 55 or less. When the Shore A hardness of the cushion layer is within the range, even better flatness tends to be able to be provided to an object to be polished. The Shore A hardness of the cushion layer can be carried out according to Japanese Industrial Standards (JIS K 7311) using an A type hardness meter.

The thickness of the cushion layer is not particularly limited and may be 0.50 mm or more and 3.0 mm or less, 0.80 mm or more and 2.5 mm or less, or 1.0 mm or more and 2.0 mm or less. The ratio of the thickness of the cushion layer to the thickness of the polishing layer is preferably 0.50 or more and 2.0 or less, more preferably 0.70 or more and 1.5 or less. When the ratio of the thickness of the cushion layer to the thickness of the polishing layer is within the range, the balance between responsivity to polishing pressure applied to a wide range of the polishing pad and responsivity to the force with which the polishing pad contacts the edge of an object to be polished tends to be able to be even more improved.

Examples of the cushion layer as described above include a nonwoven fabric impregnated with a resin, and a sponge. The nonwoven fabric in the resin-impregnated nonwoven fabric is not particularly limited, and examples thereof include nonwoven fabrics including fibers such as polyolefin-based fibers, polyamide-based fibers, and polyester-based fibers. The mode of entanglement of the nonwoven fabric is not particularly limited, and examples thereof include entanglement by needle-punching, and water jet entanglement. One of the nonwoven fabrics can be used alone, or two or more of the nonwoven fabrics can be used in combination.

The resin in the resin-impregnated nonwoven fabric is not particularly limited, and examples thereof include polyurethane-based resins; acrylic resins; vinyl-based resins such as polyvinyl chloride, polyvinyl acetate, and polyvinylidene fluoride; polysulfone-based resins such as polysulfones and polyethersulfones; acylated cellulose-based resins such as acetylated cellulose and butyrylated cellulose; polyamide-based resins; and polystyrene-based resins. One of the resins can be used alone, or two or more of the resins can be used in combination.

Examples of preferred modes of the resin-impregnated nonwoven fabric include a nonwoven fabric including polyester-based fibers impregnated with a polyurethane-based resin. By appropriately adjusting the types of the nonwoven fabric and the resin, and the amount of the resin impregnated, the density, compressibility, compressive elastic modulus, and the like of the cushion layer can be controlled.

The sponge is not particularly limited, and examples thereof include neoprene-based sponges, ethylene propylene rubber sponges, nitrile-based sponges, styrene butadiene rubber sponges, and urethane-based sponges. Among them, urethane-based sponges are preferred. By appropriately selecting and adjusting the type and void ratio of the material of the sponge, the density, compressibility, compressive elastic modulus, and the like of the cushion layer can be controlled.

[Method for Manufacturing Polishing Pad]

The method for manufacturing the polishing pad is not particularly limited as long as a polishing pad having the above configuration can be obtained. Various methods can be used. The polishing pad of this embodiment can be typically obtained by separately providing a polishing layer and a cushion layer and joining the polishing layer and the cushion layer.

(Provision of Polishing Layer)

The polishing layer may be manufactured by a known method, or a commercial one may be obtained. The polishing layer can be obtained, for example, by cutting a resin sheet from a resin block including a resin. The resin block can be obtained, for example, by curing a composition containing at least a prepolymer and a curing agent. One mode of steps for obtaining a polishing layer containing a polyurethane resin will be described below.

The polishing layer containing a polyurethane resin has the step of mixing a polyisocyanate compound and a polyol compound to prepare a urethane prepolymer, the step of mixing the urethane prepolymer and a curing agent and molding a resin block, and the step of cutting a resin sheet, which is the polishing layer, from the resin block.

The polyisocyanate compound is not particularly limited, and examples thereof include m-phenylene diisocyanate, p-phenylene diisocyanate, 2,6-tolylene diisocyanate (2,6-TDI), 2,4-tolylene diisocyanate (2,4-TDI), naphthalene-1,4-diisocyanate, diphenylmethane-4,4'-diisocyanate (MDI), 4,4'-methylene-bis(cyclohexyl isocyanate) (hydrogenated MDI), 3,3'-dimethoxy-4,4'-biphenyl diisocyanate, 3,3'-dimethyldiphenylmethane-4,4'-diisocyanate, xylylene-1,4-diisocyanate, 4,4'-diphenylpropane diisocyanate, trimethylene diisocyanate, hexamethylene diisocyanate, propylene-1,2-diisocyanate, butylene-1,2-diisocyanate, cyclohexylene-1,2-diisocyanate, cyclohexylene-1,4-diisocyanate, p-phenylene diisothiocyanate, xylylene-1,4-diisothiocyanate, and ethylidyne diisothiocyanate.

Examples of the polyol compound include diol compounds such as ethylene glycol, diethylene glycol (DEG), and butylene glycol, and triol compounds; polyether polyol compounds such as polypropylene glycol (PPG) and poly(oxytetramethylene) glycol (PTMG); polyester polyol compounds such as a reaction product of ethylene glycol and adipic acid, and a reaction product of butylene glycol and adipic acid; polycarbonate polyol compounds, and polycaprolactone polyol compounds. Trifunctional propylene glycol to which ethylene oxide is added can also be used.

For the polyisocyanate compounds and polyol compounds, one may be used alone, or two or more may be used in combination.

Among urethane prepolymers obtained by mixing a polyisocyanate compound and a polyol compound, an adduct of tolylene diisocyanate, poly(oxytetramethylene) glycol, and diethylene glycol is preferred, and an adduct of tolylene diisocyanate, two poly(oxytetramethylene) glycols having different molecular weights, and diethylene glycol is more preferred. By using such urethane prepolymers, the ratio $E'_{B40}/E'_{C40}$, and the loss factor tan δ in the dynamic viscoelasticity measurement in the bending mode can be more preferably adjusted within the above ranges.

The NCO equivalent of the urethane prepolymer obtained as described above is preferably 200 or more and 700 or less, more preferably 250 or more and 600 or less, and further preferably 300 or more and 550 or less. When the NCO equivalent is within the range, the ratio $E'_{B40}/E'_{C40}$, and the loss factor tan δ in the dynamic viscoelasticity measurement in the bending mode can be more preferably adjusted within the above ranges.

The "NCO equivalent" is a numerical value representing the molecular weight of the urethane prepolymer per NCO group obtained by "(parts by mass of polyisocyanate compound+parts by mass of polyol compound)/[(the number of functional groups per molecule of polyisocyanate compound×parts by mass of polyisocyanate compound/molecular weight of polyisocyanate compound)−(the number of functional groups per molecule of polyol compound×parts by mass of polyol compound/molecular weight of polyol compound)]".

The curing agent is not particularly limited, and examples thereof include amino group-containing compounds and hydroxyl group-containing compounds. The amino group-containing compounds are not particularly limited, and examples thereof include 4,4'-methylenebis(2-chloroaniline) (MOCA), ethylenediamine, propylenediamine, hexamethylenediamine, isophoronediamine, dicyclohexylmethane-4,4'-diamine, 4-methyl-2,6-bis(methylthio)-1,3-benzenediamine, 2-methyl-4,6-bis(methylthio)-1,3-benzenediamine, 2,2-bis(3-amino-4-hydroxyphenyl)

propane, 2,2-bis[3-(isopropylamino)-4-hydroxyphenyl]propane, 2,2-bis[3-(1-methylpropylamino)-4-hydroxyphenyl]propane, 2,2-bis[3-(1-methylpentylamino)-4-hydroxyphenyl]propane, 2,2-bis(3,5-diamino-4-hydroxyphenyl)propane, 2,6-diamino-4-methylphenol, trimethylethylenebis-4-aminobenzonate, and polytetramethylene oxide-di-p-aminobenzonate.

The hydroxyl group-containing compounds are not particularly limited, and examples thereof include ethylene glycol, propylene glycol, diethylene glycol, trimethylene glycol, tetraethylene glycol, triethylene glycol, dipropylene glycol, butanediol, pentanediol, 2,3-dimethyltrimethylene glycol, tetramethylene glycol, pentanediol, hexanediol, cyclohexanedimethanol, neopentyl glycol, glycerin, trimethylolpropane, trimethylolethane, trimethylolmethane, poly(oxytetramethylene) glycol, polyethylene glycol, and polypropylene glycol.

One of the curing agents may be used alone, or two or more of the curing agents may be used in combination. As the curing agent, diamine compounds are preferred, and 4,4'-methylenebis(2-chloroaniline) (MOCA) is more preferred. The functional group equivalent (for example, $NH_2$ equivalent or OH equivalent) of the curing agent is not particularly limited and may be, for example, 50 or more and 5000 or less, 100 or more and 4000 or less, or 120 or more and 3000 or less.

The amount of the curing agent used is preferably defined by an R value, which is the equivalent ratio of active hydrogen groups (amino groups and hydroxyl groups) present in the curing agent when the number of functional groups that the prepolymer has is 1. The amount of the curing agent used is preferably adjusted so that the R value is 0.70 or more and 1.30 or less. The R value is more preferably 0.75 or more and 1.10 or less, further preferably 0.80 or more and 1.00 or less.

In the step of mixing the urethane prepolymer and the curing agent, other additives may be mixed. Examples of the additives include a solvent, an antifoaming agent, a catalyst, a foaming agent, hollow fine particles, a foam stabilizer, and abrasive grains.

Among them, hollow fine particles are preferably added. The hollow fine particles mean fine particles having outer shells and being hollow inside. By adding the hollow fine particles to the mixture of the prepolymer and the curing agent, closed cells can be formed in the resin block. As the hollow fine particles, conventionally known various ones can be used. The hollow fine particles are not particularly limited, and examples thereof include those in which the outer shell includes an acrylonitrile-vinylidene chloride copolymer, and isobutane gas is contained in the shell.

The average particle diameter of the hollow fine particles is not particularly limited but is preferably 3.0 to 30 μm, more preferably 5.0 to 25 μm. Also by using such hollow fine particles, the ratio $E'_{B40}/E'_{C40}$, and the loss factor tan δ in the dynamic viscoelasticity measurement in the bending mode can be more preferably adjusted within the above ranges. The average particle diameter of the hollow fine particles can be measured by a laser diffraction type particle size distribution measuring apparatus (for example, Mastersizer 2000 manufactured by Spectris Co., Ltd.) or the like.

The hollow fine particles are added so that their amount is preferably 0.10 parts by mass or more and 10 parts by mass or less, more preferably 1.0 part by mass or more and 5.0 parts by mass or less, and further preferably 1.0 part by mass or more and 3.0 parts by mass or less based on 100 parts by mass of the urethane prepolymer.

By cutting a resin sheet from the resin block, the polishing layer can be obtained. The resin sheet cut from the resin block may be aged at 30 to 150° C. for about 1 h to 24 h. The resin sheet may be cut into a predetermined shape, preferably a disk shape. The surface of the resin sheet may be coated with a coating agent to provide the polishing layer. The polishing layer may have one surface or both surfaces subjected to grooving, embossing, hole processing (punching processing), and/or the like as needed. The shapes of grooving and embossing are not particularly limited, and examples thereof include shapes such as a lattice type, a concentric circle type, and a radial type.

The polishing layer may have a surface subjected to dressing (grinding treatment). The method of dressing (grinding treatment) is not particularly limited, and the surface can be ground by a known method (for example, a method using a diamond dresser or sandpaper).

(Provision of Cushion Layer)

Examples of the cushion layer include a resin-impregnated nonwoven fabric and a sponge as described above. The resin-impregnated nonwoven fabric and the sponge may be manufactured by known methods, or commercial ones may be obtained.

Examples of the method for manufacturing a resin-impregnated nonwoven fabric include a method of wet-solidifying or dry-solidifying a resin in a nonwoven fabric. The wet solidification is a method in which a nonwoven fabric is immersed in a resin solution in which a resin is dissolved in an organic solvent, and then the nonwoven fabric impregnated with the resin solution is immersed in a solidifying liquid such as water to solidify and impregnate the resin into the nonwoven fabric. The dry solidification is a method in which a nonwoven fabric is immersed in a prepolymer solution containing a prepolymer of a resin and a curing agent, and then the nonwoven fabric impregnated with the prepolymer solution is dried to react the prepolymer with the curing agent on the nonwoven fabric to impregnate the nonwoven fabric with the resin.

As the resin-impregnated nonwoven fabric, those obtained by wet solidification are preferred. As the nonwoven fabric and the resin used in the manufacture of the resin-impregnated nonwoven fabric, those illustrated in the description of the cushion layer can be used.

Examples of the method for manufacturing a sponge include a method of heating a composition including a prepolymer of a resin, a curing agent, and a foaming agent to cure the composition while foaming it. As the prepolymer and the curing agent used in the manufacture of the sponge, those illustrated for the method for manufacturing the polishing layer can be used. Examples of the foaming agent used in the manufacture of the sponge include foaming agents including water and a hydrocarbon having 5 to 6 carbon atoms as main components. Examples of the hydrocarbon include chain hydrocarbons such as n-pentane and n-hexane, and alicyclic hydrocarbons such as cyclopentane and cyclohexane.

The resin-impregnated nonwoven fabric and the sponge obtained as described above may be used as the cushion layer as they are, or those whose surfaces are sliced or buffing-treated may be provided as the cushion layer.

(Joining of Polishing Layer and Cushion Layer)

By joining the polishing layer and the cushion layer obtained as described above, the polishing pad can be obtained. The method for joining the polishing layer and the cushion layer is not particularly limited, and examples thereof include adhesion with an adhesive agent and adhesion with an adhesive sheet. Adhesion with an adhesive sheet is preferred. The adhesive sheet is not particularly limited, and various adhesive sheets such as pressure-sensitive adhesive sheets and heat-sensitive adhesive sheets can be used. An adhesive sheet in which a pressure-sensitive adhesive is formed on one surface, and a heat-sensitive adhesive is formed on the other surface can also be used.

[Method for Manufacturing Polished Product]

A method for manufacturing a polished product in this embodiment includes the polishing step of polishing an object to be polished, using the polishing pad, to obtain a polished product. The polishing step may be primary polishing (rough polishing), finish polishing, or polishing in which both the polishings are combined.

In the polishing step, the object to be polished is pressed against the polishing pad side by a holding surface plate. At this time, the holding surface plate and the polishing surface plate rotate relatively, and thus the processing surface of the object to be polished is polished by the polishing pad. The holding surface plate and the polishing surface plate may rotate in the same direction or in different directions at different rotation speeds from each other. The object to be polished may be polished while moving (rotating) inside the frame portion, during the polishing processing.

In the polishing step, typically, polishing slurry is supplied, and the polishing by the polishing pad is assisted. The polishing slurry may include water, a chemical component such as an oxidant typified by hydrogen peroxide, an additive, abrasive grains (polishing particles; for example, SiC, $SiO_2$, $Al_2O_3$, or $CeO_2$), and the like according to the object to be polished, the polishing conditions, and the like.

The object to be polished is not particularly limited, and examples thereof include materials such as optical materials such as lenses, plane parallel plates, and reflective mirrors, semiconductor wafers, semiconductor devices, hard disk substrates, glass substrates, and electronic components. Among them, the method for manufacturing a polished product in this embodiment can be preferably used as a method for manufacturing a semiconductor device in which an oxide layer, a metal layer, and/or the like are formed on a semiconductor wafer, or the like because good flatness can be provided to the object to be polished.

EXAMPLES

The present invention will be more specifically described below using Examples and a Comparative Example. The present invention is not limited in any way by the following Examples.

[Methods for Measuring Physical Properties of Polishing Layer and Cushion Layer]

(Density)

Sample pieces having a predetermined size were cut from a polishing layer and a cushion layer, and the volume and mass of each sample piece were measured. The measured mass was divided by the volume to calculate the density.

(Compressibility and Compressive Elastic Modulus)

Measurement was carried out as described above according to Japanese Industrial Standards (JIS L 1021) using a Schopper type thickness gauge (pressurizing surface: a circle having a diameter of 1 cm). The initial load was 100 g/cm$^2$, and the final pressure was 1120 g/cm$^2$.

(D Hardness of Polishing Layer)

Measurement was performed according to Japanese Industrial Standards (JIS K 7311) using a D type hardness meter. The measurement was performed by stacking a plurality of samples so that the thickness of the measurement sample was at least 4.5 mm or more.

(A Hardness of Cushion Layer)

Measurement was performed according to Japanese Industrial Standards (JIS K 7311) using an A type hardness meter. The measurement was performed by stacking a plurality of samples so that the thickness of the measurement sample was at least 4.5 mm or more.

Example 1

A polishing layer was manufactured as follows.

First, 2,4-tolylene diisocyanate (TDI), poly(oxytetramethylene) glycol (PTMG) having a number average molecular weight of 1000, PTMG having a number average molecular weight of 650, and diethylene glycol (DEG) were reacted, then heated to 40° C., and defoamed under reduced pressure to prepare a urethane prepolymer having an NCO equivalent of 420.

Next, 100 parts by mass of the urethane prepolymer and 2.5 parts by mass of unexpanded hollow fine particles (average particle diameter 8.5 μm) in which the outer shell included an acrylonitrile-vinylidene chloride copolymer, and isobutane gas was contained in the shell were placed in a first liquid tank and mixed to obtain a urethane prepolymer mixed liquid, and the urethane prepolymer mixed liquid was kept at 60° C. Apart from the urethane prepolymer mixed liquid, 28.0 parts by mass of 4,4'-methylenebis(2-chloroaniline) (MOCA) as a curing agent was placed in a second liquid tank, mixed at 120° C., and further defoamed under reduced pressure to obtain a curing agent melt. The urethane prepolymer mixed liquid and the curing agent melt were mixed to obtain a mixed liquid. At this time, the mixing proportion was adjusted so that the R value, representing the equivalent ratio of the amino group and the hydroxyl group present in the curing agent to the isocyanate group present at an end in the urethane prepolymer, was 0.90.

The obtained mixed liquid was cast in a mold preheated to 80° C., and subjected to primary curing at 80° C. for 30 min. The block-shaped molded material formed thus was extracted from the mold and subjected to secondary curing in an oven at 120° C. for 4 h to obtain a urethane resin block. The obtained urethane resin block was allowed to cool to 25° C., then heated again in an oven at 120° C. for 5 h, and then subjected to slicing treatment to obtain a 1.3 mm thick polishing layer (the polishing layer is hereinafter referred to as a "polishing layer 1").

A cushion layer was manufactured as follows.

First, a nonwoven fabric including polyester fibers having a density of 0.15 g/cm$^3$ was immersed in a resin solution (DMF solvent) including a urethane resin (manufactured by DIC CORPORATION, product name "C1367"). After the immersion, the resin solution was squeezed from the nonwoven fabric using mangle rollers capable of pressurization between the pair of rollers to generally uniformly impregnate the nonwoven fabric with the resin solution. Then, the nonwoven fabric impregnated with the resin solution was immersed in a solidifying liquid including water at room temperature to wet-solidify the resin to obtain a resin-impregnated nonwoven fabric. Subsequently, the resin-impregnated nonwoven fabric was taken out of the solidifying liquid, further washed with a washing liquid consisting of water to remove the N,N-dimethylformamide (DMF) in the resin, and dried. After the drying, the skin layer on the resin-impregnated nonwoven fabric surface was removed by buffing treatment to obtain a 1.3 mm thick cushion layer which is the resin-impregnated nonwoven fabric (the cushion layer is hereinafter referred to as a "cushion layer 1").

The polishing layer 1 and the cushion layer 1 obtained as described above were adhered by an adhesive sheet to obtain a polishing pad. As the adhesive sheet, a double-sided tape in which an acrylic adhesive was formed on a PET base material was used. The measurement results of various physical properties of the polishing layer 1 and the cushion layer 1 are shown in Table 1.

Example 2

A polishing pad was obtained in the same manner as Example 1 except that as the cushion layer, a 1.5 mm thick urethane-based sponge (hereinafter referred to as a "cushion layer 2") was used instead of the resin-impregnated nonwoven fabric. As the urethane-based sponge, a commercial sponge having various physical properties shown in Table 1 was used.

Example 3

A polishing pad was obtained in the same manner as Example 1 except that as the cushion layer, a 1.4 mm thick urethane-based sponge (hereinafter referred to as a "cushion layer 3") was used instead of the resin-impregnated nonwoven fabric. As the urethane-based sponge, a commercial sponge having various physical properties shown in Table 1 was used.

Example 4

A polishing pad was obtained in the same manner as Example 1 except that as the cushion layer, a 1.4 mm thick urethane-based sponge (hereinafter referred to as a "cushion layer 4") was used instead of the resin-impregnated nonwoven fabric. As the urethane-based sponge, a commercial sponge having various physical properties shown in Table 1 was used.

Comparative Example 1

A polishing pad was obtained in the same manner as Example 1 except that as the polishing layer, a polishing layer manufactured as follows was used.

The polishing layer was manufactured as follows.

First, 2,4-tolylene diisocyanate (TDI), poly(oxytetramethylene) glycol (PTMG) having a number average molecular weight of 1000, PTMG having a number average molecular weight of 650, and diethylene glycol (DEG) were reacted, then heated to 40° C., and defoamed under reduced pressure to prepare a urethane prepolymer having an NCO equivalent of 420.

Next, 100 parts by mass of the urethane prepolymer, 3.1 parts by mass of the same hollow fine particles as Example 1, and 2.0 parts by mass of 4,4'-methylene-bis(cyclohexyl isocyanate) (hydrogenated MDI) were placed in a first liquid tank and mixed to obtain a urethane prepolymer mixed liquid, and the urethane prepolymer mixed liquid was kept at 60° C. Apart from the urethane prepolymer mixed liquid, 28.0 parts by mass of 4,4'-methylenebis(2-chloroaniline) (MOCA) as a curing agent was placed in a second liquid tank, mixed at 120° C., and further defoamed under reduced pressure to obtain a curing agent melt. The urethane prepolymer mixed liquid and the curing agent melt were mixed to obtain a mixed liquid. At this time, the mixing proportion was adjusted so that the R value, representing the equivalent ratio of the amino group and the hydroxyl group present in the curing agent to the isocyanate group present at an end in the urethane prepolymer, was 0.90.

The obtained mixed liquid was cast in a mold and subjected to primary curing at 110° C. for 30 min. The block-shaped molded material formed thus was extracted from the mold and subjected to secondary curing in an oven at 130° C. for 2 h to obtain a urethane resin block. The obtained urethane resin block was allowed to cool to 25° C., then heated again in an oven at 120° C. for 5 h, and then subjected to slicing treatment to obtain a 1.3 mm thick polishing layer (the polishing layer is hereinafter referred to as a "polishing layer 2"). The measurement results of various physical properties of the polishing layer 2 are shown in Table 1.

TABLE 1

| | Density ($g/cm^3$) | Compressibility (%) | Compressive elastic modulus (%) | D hardness (—) | A hardness (—) |
|---|---|---|---|---|---|
| Polishing layer 1 | 0.78 | 0.80 | 74 | 63 | — |
| Polishing layer 2 | 0.79 | 0.40 | 77 | 62 | — |
| Cushion layer 1 | 0.30 | 7.2 | 89 | — | 52 |
| Cushion layer 2 | 0.33 | 18.8 | 98 | — | 22 |
| Cushion layer 3 | 0.49 | 4.2 | 95 | — | 39 |
| Cushion layer 4 | 0.56 | 3.8 | 90 | — | 48 |

[Dynamic Viscoelasticity Measurement]

(Bending Mode Conditions)

For the polishing pads in the examples, dynamic viscoelasticity measurement in the bending mode was performed as follows. First, the polishing pad was held in a constant temperature and humidity tank at a temperature of 23° C. (±2° C.) and a relative humidity of 50% (±5%) for 40 h. Dynamic viscoelasticity measurement in the bending mode was performed under the usual air atmosphere (dry state) under the following conditions using the obtained polishing pad as a sample. As the dynamic viscoelasticity measuring apparatus, the product name "RSA3" manufactured by TA Instruments was used. The measurement results of Example 1, Example 2, and Comparative Example 1 are shown in FIGS. 1 to 3 respectively. The measurement results of Examples 3 and 4 are shown in FIGS. 4 and 5 respectively.

(Measurement Conditions)

Sample size: 5 mm long×50 mm wide
Measurement length: frame size 30 mm, center clamp 6 mm
Test mode: three-point bending
Frequency: 10 rad/sec (1.6 Hz)
Temperature range: 20 to 100° C.
Temperature increase rate: 5° C./min
Strain range: 0.10% (with respect to the thickness of the polishing pad)
Initial load: 0 g
Measurement interval: 1 point/° C.

(Compression Mode Conditions)

For the polishing pads in the examples, dynamic viscoelasticity measurement in the compression mode was performed as follows. First, the polishing pad was held in a constant temperature and humidity tank at a temperature of 23° C. (±2° C.) and a relative humidity of 50% (±5%) for 40 h. Dynamic viscoelasticity measurement in the compression mode was performed under the usual air atmosphere (dry state) under the following conditions using the obtained polishing pad as a sample. As the dynamic viscoelasticity measuring apparatus, the product name "RSA3" manufactured by TA Instruments was used. The storage elastic moduli at 40° C. in the dynamic viscoelasticity measurement in the compression mode, $E'_{C40}$, obtained from the measurement results for the examples are shown in Tables 2 and 3.

(Measurement Conditions)

Sample size: 5 mm long×5 mm wide

Measurement length: 5 mm long×5 mm wide

Test mode: compression

Frequency: 10 rad/sec (1.6 Hz)

Temperature range: 20 to 100° C.

Temperature increase rate: 5° C./min

Strain range: 0.10% (with respect to the thickness of the polishing pad)

Initial load: 62 g

Measurement interval: 1 point/° C.

From the results of the dynamic viscoelasticity measurement, the storage elastic modulus at 40° C. in the dynamic viscoelasticity measurement in the bending mode, $E'_{B40}$, the ratio $E'_{B40}/E'_{C40}$, the minimum value tan $\delta_{min}$ and maximum value tan $\delta_{max}$ of the loss factor tan δ in the range of 40° C. or more and 70° C. or less in the dynamic viscoelasticity measurement in the bending mode, and the ratio of the storage elastic modulus at 30° C., $E'_{B30}$, to the storage elastic modulus at 90° C., $E'_{B90}$, the ratio being $E'_{B30}/E'_{B90}$, in the dynamic viscoelasticity measurement in the bending mode were obtained. The values of the above in the examples are shown in Tables 2 and 3.

[Evaluation of Flatness]

(Dishing Evaluation)

First, a copper pattern wafer (ATDF754 mask, copper film thickness before polishing: 700 nm, trench depth: 300 nm, insulating material: TEOS) having a pattern having copper wiring width L and insulating film width S (L/S=50 μm/50 μm) was polishing-treated under the following conditions using each of the polishing pads in the examples. The copper pattern wafer after the polishing was scanned by a contact type height difference meter (P-16 manufactured by KLA-Tencor) to measure the difference between the film thickness of the insulating film portion and the film thickness of the copper wiring portion, and its absolute value was taken as the amount of dishing. For the amount of dishing (unit: nm), it is indicated that as the numerical value becomes smaller, the flatness becomes higher and more preferred.

(Evaluation Criteria)

A: the amount of dishing is less than 450

B: the amount of dishing is 450 or more and less than 500

C: the amount of dishing is 500 or more (Erosion Evaluation)

First, a copper pattern wafer (ATDF754 mask, copper film thickness before polishing: 700 nm, trench depth: 300 nm, insulating material: TEOS) having a pattern having copper wiring width L and insulating film width S (L/S=0.25 μm/0.25 μm) was polishing-treated under the following conditions using each of the polishing pads in the examples. The copper pattern wafer after the polishing was scanned by a contact type height difference meter (P-16 manufactured by KLA-Tencor) to measure the difference between the film thickness of the insulating film portion and the film thickness of the copper wiring portion, and its absolute value was taken as the amount of erosion. For the amount of erosion (unit: nm), it is indicated that as the numerical value becomes smaller, the flatness becomes higher and more preferred.

(Evaluation Criteria)

A: the amount of erosion is less than 10

B: the amount of erosion is 10 or more and less than

C: the amount of erosion is 30 or more (Polishing Conditions)

Polishing machine used: manufactured by EBARA CORPORATION, product name "F-REX300"

Polishing pressure: 3.5 psi

Polishing agent: manufactured by FUJIMI CORPORATION, product name "PLANERLITE"

Dresser: manufactured by 3M, diamond dresser, model number "A188"

Pad break: 35 N 10 min, diamond dresser 54 rpm, surface plate rotation speed 80 rpm, ultrapure water 200 mL/min Conditioning: Ex-situ, 35 N, 4 scans Polishing: surface plate rotation speed 70 rpm, head rotation speed 71 rpm, slurry flow rate 200 mL/min Polishing time: 60 s The evaluation of flatness for the polishing pads in the examples is shown in Tables 2 and 3.

TABLE 2

| | | Example 1 | Example 2 | Comparative Example 1 |
|---|---|---|---|---|
| Dynamic viscoelasticity measurement | $E'_{B40}$ (MPa) | 45.3 | 32.9 | 54.5 |
| | $E'_{C40}$ (MPa) | 7.8 | 3.6 | 7.2 |
| | $E'_{B40}/E'_{C40}$ (—) | 5.8 | 9.1 | 7.6 |
| | tan $\delta_{max}$ (—) | 0.21 | 0.18 | 0.34 |
| | tan $\delta_{min}$ (—) | 0.17 | 0.15 | 0.20 |
| | $E'_{B30}/E'_{B90}$ (—) | 4.9 | 4.9 | 12.1 |
| Flatness (erosion) | | A | A | C |
| Flatness (dishing) | | A | A | C |

TABLE 3

| | | Example 3 | Example 4 |
|---|---|---|---|
| Dynamic viscoelasticity measurement | $E'_{B40}$ (MPa) | 36.8 | 45.5 |
| | $E'_{C40}$ (MPa) | 6.7 | 8.2 |
| | $E'_{B40}/E'_{C40}$ (—) | 5.5 | 5.6 |
| | tan $\delta_{max}$ (—) | 0.19 | 0.20 |
| | tan $\delta_{min}$ (—) | 0.17 | 0.18 |
| | $E'_{B30}/E'_{B90}$ (—) | 4.1 | 4.5 |
| Flatness (erosion) | | A | A |
| Flatness (dishing) | | A | A |

From Tables 2 and 3, it is found that with the polishing pads of Examples 1 to 4 in which the ratio $E'_{B40}/E'_{C40}$ is 3.0 or more and 15.0 or less, and the loss factor tan δ in the dynamic viscoelasticity measurement in the bending mode is 0.10 or more and 0.30 or less in the range of 40° C. or more and 70° C. or less, good flatness can be provided to an object to be polished.

INDUSTRIAL APPLICABILITY

The polishing pad of the present invention has industrial applicability as a polishing pad used for the polishing of materials such as optical materials such as lenses, plane parallel plates, and reflective mirrors, semiconductor wafers, semiconductor devices, hard disk substrates, glass substrates, and electronic components, and the like and preferably used particularly for polishing semiconductor devices in which an oxide layer, a metal layer, and/or the like are formed on a semiconductor wafer, and the like.

The invention claimed is:

1. A polishing pad comprising a polishing layer and a cushion layer, wherein a ratio $E'_{B40}/E'_{C40}$ of a storage elastic modulus of the polishing pad at 40° C. in dynamic viscoelasticity measurement to the polishing pad performed under a bending mode condition with a dry state, a frequency of 10 rad/s, and 20 to 100° C., $E'_{B40}$, to a storage elastic modulus of the polishing pad at 40° C. in dynamic viscoelasticity measurement to the polishing pad performed under a compression mode condition with a dry state, a frequency of 10 rad/s, and 20 to 100° C., $E'_{C40}$, is 3.0 or more and 15.0 or less, and a loss factor tan δ of the polishing pad in the dynamic viscoelasticity measurement to the polishing pad performed under the bending mode condition is 0.10 or more and 0.30 or less in a range of 40° C. or more and 70° C. or less.

2. The polishing pad according to claim 1, wherein a ratio $E'_{B30}/E'_{B90}$ of a storage elastic modulus of the polishing pad at 30° C., $E'_{B30}$, to a storage elastic modulus of the polishing pad at 90° C., $E'_{B90}$, in the dynamic viscoelasticity measurement to the polishing pad performed under the bending mode condition is 1.0 or more and 8.0 or less.

3. The polishing pad according to claim 1, wherein a density of the cushion layer is 0.10 g/cm$^3$ or more and 0.60 g/cm$^3$ or less, and a compressibility of the cushion layer is 3.0% or more and 30.0% or less.

4. The polishing pad according to claim 1, wherein a density of the polishing layer is 0.60 g/cm$^3$ or more and 1.1 g/cm$^3$ or less, and a compressibility of the polishing layer is 0.10% or more and 3.0% or less.

5. The polishing pad according to claim 1, wherein a Shore D hardness of the polishing layer is 40 or more and 80 or less.

6. The polishing pad according to claim 1, wherein a ratio of a thickness of the cushion layer to a thickness of the polishing layer is 0.50 or more and 2.0 or less.

7. The polishing pad according to claim 1, wherein the polishing layer contains a polyurethane resin.

8. A method for manufacturing a polished product, comprising:

a polishing step of polishing an object to be polished, using the polishing pad according to claim 1.

* * * * *